United States Patent [19]

Hinman, Jr. et al.

[11] 4,108,075

[45] Aug. 22, 1978

[54] MEANS FOR SUPPRESSING OSCILLATOR-GENERATED NOISE IN DOPPLER PROXIMITY FUZES

[75] Inventors: Wilbur S. Hinman, Jr., Arlington, Va.; Helmut Sommer, Bethesda; Louis M. Tozzi, Takoma Park, both of Md.

[73] Assignee: The United States of America as represented by the Secretary of the Army, Washington, D.C.

[21] Appl. No.: 805,348

[22] Filed: Apr. 9, 1959

[51] Int. Cl.[2] ..... F42C 13/04

[52] U.S. Cl. ..... 102/214

[58] Field of Search ..... 102/70.2; 250/20.54, 250/27.1–27.5, 20.54 D; 343/7, 13.1

[56] References Cited

U.S. PATENT DOCUMENTS

| | | | |
|---|---|---|---|
| 2,422,374 | 6/1947 | Strebe et al. | 250/20.54 |
| 2,482,549 | 9/1949 | Killman et al. | 250/20.54 |
| 2,760,188 | 8/1956 | Guanella et al. | 343/7 |
| 2,873,679 | 2/1959 | Gibson | 343/7 |

FOREIGN PATENT DOCUMENTS

| | | | |
|---|---|---|---|
| 585,791 | 2/1947 | United Kingdom | 102/70.2 |

*Primary Examiner*—Charles T. Jordan
*Attorney, Agent, or Firm*—Nathan Edelberg; Robert P. Gibson; Saul Elbaum

EXEMPLARY CLAIM

1. In a doppler proximity fuzing system including an oscillating detector providing diode detection, an antenna to which the output of said oscillating detector is coupled, and an amplifier to which the detected signal from said oscillating detector is fed, the improvement comprising means for suppressing oscillator-generated noise, said means including a 45° r-f phase shift network connected between the output of said oscillating detector and said antenna, diode detection means connected to said antenna and poled oppositely to the diode detection provided by said oscillating detector, the detected signal from said diode detection means being fed to said amplifier along with the detected signal from said oscillating detector, and means to which at least one of said detected signals is fed prior to application to said amplifier for adjusting the magnitude of the detected oscillator-generated noise appearing in one of said detected signals to be substantially equal to the magnitude of the detected oscillator-generated noise appearing in the other of said signals.

4 Claims, 1 Drawing Figure

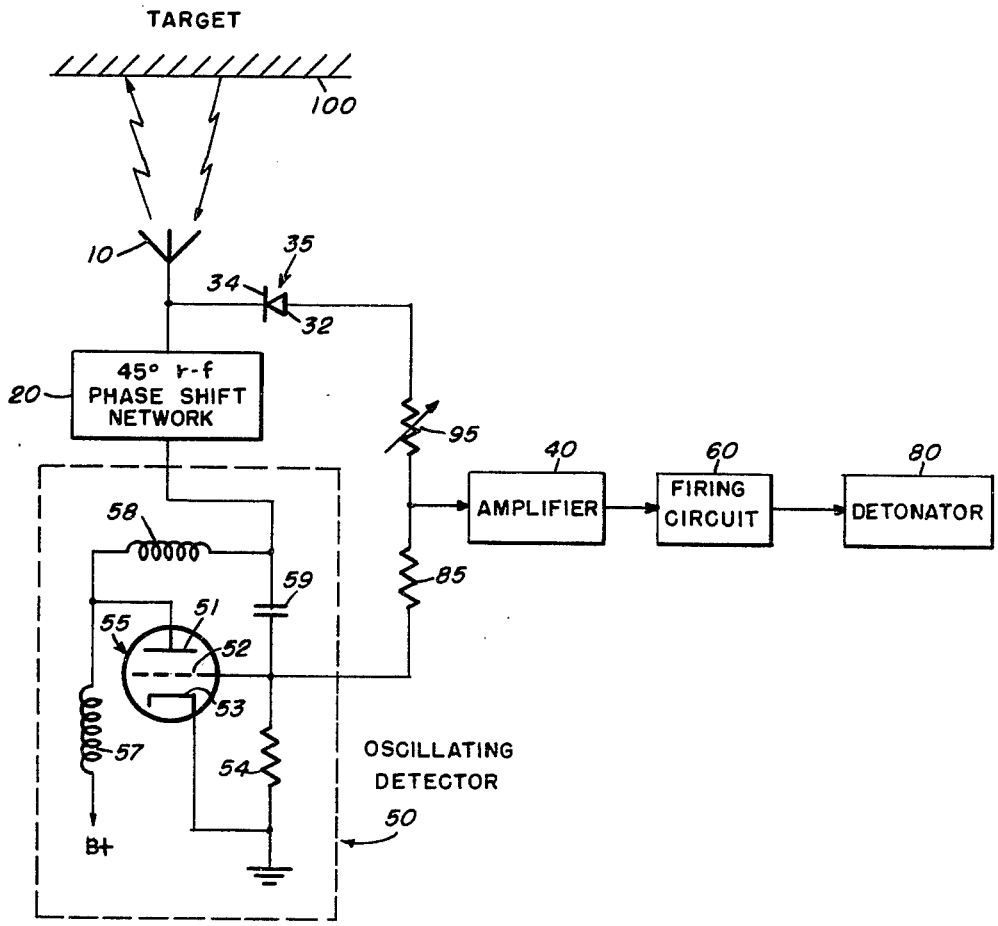
TARGET
100
10
35
34
32
45° r-f
PHASE SHIFT
NETWORK
20
95
40
AMPLIFIER
60
FIRING
CIRCUIT
80
DETONATOR
58
59
85
51
55
52
53
57
54
B+
OSCILLATING
DETECTOR
50

MEANS FOR SUPPRESSING OSCILLATOR-GENERATED NOISE IN DOPPLER PROXIMITY FUZES

The invention described herein may be manufactured and used by or for the Government for governmental purposes without the payment to us of any royalty thereon.

This invention relates generally to ordnance proximity fuzes of the doppler type. More particularly, this invention relates to means for suppressing noise generated in the oscillator of a doppler proximity fuze without reducing the sensitivity of the system.

Noise generated in the oscillator of a doppler proximity fuze from such causes as microphonics, spontaneous emission, spurious charging, power supply variations, etc., has been found to place a severe limit on the reliability and maximum usable function height of doppler fuzes. (The noise referred to herein should be distinguished from thermal noise which is generally several orders of magnitude less, and should not be confused with externallyoriginated noise such as jamming.) Much time and effort has been expended to develop special low noise tubes and to devise special circuitry to minimize the effects of this oscillator-generated noise; but up to the present time neither low noise tubes nor the specially devised circuitry has been entirely satisfactory in overcoming the problem.

The reason why oscillator-generated noise is such a problem in doppler proximity fuzes stems from the basic operation of a doppler system as will hereinafter be pointed out. In one type of conventional doppler proximity fuze, a single triode tube serves as both an oscillator and a detector. An antenna is adapted to radiate the oscillator energy and to receive the radiated energy returned to the antenna after reflection from a target. Because of the well known doppler effect, relative motion between the fuze and the target causes the reflected signal received at the antenna to be shifted in frequency from the signal generated by the oscillator by an amount proportional to the relative velocity, the difference in frequency between the two signals being known as the doppler frequency. The diode action of the grid and cathode of the oscillator tube gives rise to a doppler frequency signal at the grid which is then amplified and fed to a firing circuit. The amplifier and firing circuit are adapted so that the missile detonator is fired when the doppler signal is within a predetermined frequency range and reaches a predetermined amplitude.

From the above, it can be seen that it is the detected doppler signal appearing at the oscillator grid which provides the basic information of target proximity. However, noise generated in the oscillator causes amplitude modulation of the oscillator signal so that it also appears as a detected signal at the oscillator grid, and this detected noise signal is ordinarily within the range of doppler frequencies to which the fuze amplifier is designed to respond. Since the doppler signal is only of the order of a few millivolts and must be amplified, the amount of amplification which can be provided will be limited by the amount of detected noise present. The presence of oscillatorgenerated noise, therefore, which is quite appreciable in missile fuzing systems because of microphonics caused by missile vibration, severely limits the reliability and sensitivity which can be obtained from a conventional doppler fuzing system.

Attempts at devising special circuitry to overcome oscillatorgenerated noise have taken the form of suppressing the amplitude modulated noise appearing on the oscillator signal fed to the fuze antenna. However, it will be understood that amplitude modulation suppression means which might be employed have the great disadvantage of also acting to correspondingly decrease the reflected target signal appearing in the antenna, which inherently reduces the sensitivity of the system. As a result, it has been found that the overall advantages obtained from the use of such amplitude modulation suppression means are not worth the additional circuitry they require, particularly because space is at such a premium in ordnance missiles.

Accordingly, it is the chief object of this invention to provide means for suppressing noise generated in the oscillator of a doppler proximity fuze without reducing the sensitivity of the system.

It is a further object to incorporate the above-mentioned means in a doppler fuzing system with a minimum of additionally required components therefor.

In accordance with the present invention, no attempt is made to suppress the noise in the oscillator-detector. Instead, means are provided for performing two independent detections so that two detected signals are produced, and then balanced in such a way that oscillator-generated noise is cancelled without reducing the sensitivity of the system; and only a minimum of additional components are necessary to incorporate these means in a doppler proximity fuzing system.

The specific nature of the invention, as well as other objects, uses and advantages thereof, will clearly appear from the following description and from the accompanying drawing, in which:

The drawing is a schematic and block diagram of a doppler proximity fuze in which the invention is incorporated.

In the drawing, an oscillating detector 50 feeds a conventional form of fuze antenna 10 through a 45° radiofrequency phase shift network 20. The oscillating detector 50 comprises a vacuum subminiature triode 55 having a plate 51, a grid 52 and a cathode 53 connected for operation as an oscillating detector in accordance with well known practice. A capacitor 59 and a coil 58, series resonant at the desired r-f oscillation frequency, are connected in series between the grid 52 and the plate 51 of the tube 55. Direct current power is obtained from a B+ source which is connected to the plate 51 through an r-f choke 57, and a grid resistor 54 is connected between the grid 52 and the grounded cathode 53. It is to be understood that the specific oscillating detector 50 shown in the drawing is only exemplary and any other type may be used as desired. The generated oscillator energy is coupled from the oscillating detector to a 45° r-f phase shift network 20 in any suitable manner, such as by connecting one end of the phase shift network 20 to one side of the coil 58 as shown in the drawing. The 45° *r-f* phase shift network 20 may be any network, familiar to those skilled in the art, which will cause the signal at one end to be 45° out of phase with the signal at the other end at the oscillation frequency, but which will produce negligible phase shift at doppler frequencies. The impedance of the antenna 10 is adjusted in conjunction with the phase network 20 and the output impedance of the oscillating detector 50 to provide the greatest radiation efficiency in accordance with well known practice.

Also connected to the antenna 10 is a diode 35 having its cathode 34 connected to the antenna 10 and its plate 32 connected to a conventional fuze amplifier 40 through an adjustable resistor 95. The grid 52 of the oscillating detector 50 is also connected to the fuze amplifier 40 through a resistor 85. The output of the amplifier 40 is fed to a conventional firing circuit 60 which activates a detonator 80 when the amplified doppler signal at the output of the amplifier 40 reaches a predetermined amplitude.

The operation of the illustrative embodiment of the invention shown in the drawing may be explained as follows. Oscillation energy from the oscillating detector 50 is shifted in phase by 45 degrees and applied to the antenna 10 to be radiated therefrom to a target 100. The energy reflected from the target is received by the antenna 10 causing a received signal to appear in the antenna which is shifted in frequency from the oscillator frequency by an amount equal to the doppler frequency resulting from relative motion between the fuze and target. The received signal in the antenna 10 is shifted in phase by 45 degrees by the network 20 before being applied to the oscillating detector 50.

Two independent detections now take place in the embodiment shown in the drawing.

In accordance with conventional oscillating-detector operation, a first detected doppler frequency signal appears at the grid 52 as a result of the mixing of the oscillator signal with the 45 degree phase shifted received signal, caused by the action of the diode formed by the grid 52 and the cathode 53 of the tube 55. This first detected signal is fed to the amplifier 40 through a resistor 85. Any amplitude modulated noise on the oscillator signal also appears at the grid 52 because of the diode action of the grid 52 and the cathode 53, and is also fed to the amplifier 40 through the resistor 85. In the conventional form of doppler proximity fuze, no attempt is made to reduce this noise because of the unavailability of satisfactory circuitry, the amount of such noise being kept within practical limits by the use of a specially designed low-noise tube in the oscillating-detector 50.

In accordance with the present invention, however, this noise is very considerably reduced without reducing the sensitivity of the system, as will now be explained. A second detected doppler frequency signal is fed to the amplifier 40 through the adjustable resistor 95 as a result of the mixing of the 45 degree phase shifted oscillator signal with the received signal, caused by the action of the diode 35. Since the first detected signal is obtained as a result of the mixing of the oscillator signal with the 45 degree phase shifted received signal, it will be understood that the first and second detected doppler frequency signals fed to the amplifier 40 will thereby be in phase quadrature with respect to one another, and will add in phase quadrature in the amplifier 40. However, the amplitude modulated noise on the 45 degree phase shifted oscillator signal appearing at the antenna 10, which is also detected by the diode 35 and fed to the amplifier 40 through the adjustable resistor 95, will be 180 degrees out of phase with the detected noise signal from the grid 52 of the oscillating detector 50. This is the case because differences in the *r-f* phase of an amplitude modulated signal do not affect the phase of the resulting signals obtained after detection. But the phases of the detected doppler frequency signals are affected because detection is obtained by mixing two signals differing in frequency by the doppler frequency, and different phase relationships between these two signals for two independent detections thereof will cause corresponding phase differences to be produced between the two detected signals obtained. Or looking at it another way, the diodes 35 and 52, 53 act as phase detectors to mix the oscillator and received signals, while at the same time acting as amplitude detectors for the noise amplitude modulation on the oscillation signal. Thus, since the diode 35 is oppositely poled to the diode formed by the grid 52 and the cathode 53, the detected amplitude modulated noise applied to the amplifier 40 from the diode 35 will be 180 degrees out of phase with the detected amplitude modulated noise from the grid 52 of the oscillating detector 50. By adjusting the adjustable resistor 95 in relation to the value of the resistor 85 to a value so that the two detected noise signals applied to the amplifier are equal, it will be understood that the noise signals will thereby be cancelled and not appear in the amplifier 40. It will be realized that the resistor 85 could be made adjustable if so desired instead of the resistor 95, and either resistor 85 or 95 may be omitted where balancing can be obtained using the adjustable resistor alone.

From the above it can be seen that merely by adding to the conventional doppler proximity fuze circuity the relative few components comprising the 45° *r-f* phase shift network 20, the diode 35 to provide a second and independent detection, the adjustable resistor 95 and the associated balancing resistor 85, the oscillator-generated noise is effectively cancelled out so that it will not appear in the fuze amplifier 40. But the sensitivity of the system is maintained because the resultant detected doppler frequency signal obtained after adding in quadrature the two independently detected doppler signals, more than makes up for any loss of sensitivity which might result because of the use of the phase shift network 20 and the resistors 85 and 95. It is realized, of course, that in practice complete noise cancellation is not possible. However, the noise suppression obtained is very much greater than was ever before possible, so that the reliability and maximum function height of doppler proximity fuzing systems may be correspondingly extended, and this important step forward is achieved with a minimum of additionally required parts.

Although this invention has been illustrated as embodied in a doppler proximity fuze, it is to be understood that its use may be extended to any application where the characteristics of a doppler proximity fuze are desired and there is a problem of oscillator-generated noise. It will be apparent, therefore, that the illustrative embodiment described is only exemplary and that various modifications can be made in construction and arrangement within the scope of the invention as defined in the appended claims.

We claim as our invention:

1. In a doppler proximity fuzing system including an oscillating detector providing diode detection, an antenna to which the output of said oscillating detector is coupled, and an amplifier to which the detected signal from said oscillating detector is fed, the improvement comprising means for suppressing oscillator-generated noise, said means including a 45° r-f phase shift network connected between the output of said oscillating detector and said antenna, diode detection means connected to said antenna and poled oppositely to the diode detection provided by said oscillating detector, the detected signal from said diode detection means being fed to said amplifier along with the detected signal from said oscillating detector, and means to which at least one of said detected signals is fed prior to application to said amplifier for adjusting the magnitude of the detected oscillator-generated noise appearing in one of said detected signals to be substantially equal to the magnitude of the detected oscillator-generated noise appearing in the other of said signals.

2. A doppler proximity fuzing system in which oscillator-generated noise is suppressed, said system comprising in combination: an oscillating detector, an antenna to which the output of said oscillating detector is coupled, said oscillating detector providing a first detected signal consisting of a first doppler frequency signal obtained from the mixing of the oscillation signal with the reflected signal from a target and a first noise signal obtained from the detection of noise amplitude modulation on the oscillation signal, means cooperating with said antenna and said oscillating detector for obtaining a second detected signal consisting of a second doppler frequency signal in quadrature with said first doppler frequency signal and a second noise signal 180° out of phase with said first noise signal, an amplifier to which said first and second detected signals are fed, means to which at least one of said detected signals is fed prior to application to said amplifier for adjusting the magnitude of said first noise signal to be substantially equal to the magnitude of said second noise signal, a detonator, and means connected to the output of said amplifier for activating said detonator when the amplified signal from said amplifier reaches a predetermined value.

3. A doppler proximity fuzing system in which oscillator-generated noise is suppressed, said system comprising in combination: an oscillating detector, an antenna to which the r-f output of said oscillating detector is coupled, a 45° r-f phase shift network connected between said antenna and said oscillating detector, a diode having its cathode connected to said antenna, a first resistor which is adjustable having one end connected to the plate of said diode, an amplifier, the other end of said first resistor being connected to the input of said amplifier, a second resistor having one end connected to the detected output of said oscillating detector and the other end also connected to the input of said amplifier, said first and second resistors being chosen so that the detected oscillator-generated noise fed to said amplifier from said oscillating detector has a magnitude substantially equal to the detected oscillator-generated noise fed to said amplifier from said diode, a detonator, and a firing circuit connected between said amplifier and said detonator for firing said detonator when the output of said amplifier reaches a predetermined amplitude.

4. In a doppler proximity fuzing system in which oscillator generated noise is suppressed, an oscillating detector providing an *r-f* oscillation signal at a first output and a first detected signal at a second output, an antenna, a 45° *r-f* phase shift network connected between said oscillating detector first output and said antenna, a diode having its cathode connected to said antenna for providing a second detected signal, each of said detected signals consisting of a doppler frequency signal obtained by mixing said *r-f* oscillation signal with the reflected signal from a target received by said antenna and a noise signal obtained from the detection of noise amplitude modulation on said *r-f* oscillation signal, said doppler frequency signals being in phase quadrature and said noise signals being 180° out of phase, an amplifier having an input and an output, a resistor connected between said oscillating detector second output and said amplifier input, an adjustable resistor connected between the anode of said diode and said amplifier input for balancing the magnitudes of said noise signals whereby oscillator generated noise is suppressed, a detonator, and a firing circuit connected between said amplifier output and said detonator for firing said detonator when the output of said amplifier reaches a predetermined amplitude.

* * * * *